US007425973B2

(12) United States Patent
Han

(10) Patent No.: US 7,425,973 B2
(45) Date of Patent: Sep. 16, 2008

(54) THERMAL TYPE IMAGE FORMING APPARATUS

(75) Inventor: Dong-hun Han, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 248 days.

(21) Appl. No.: 11/385,800

(22) Filed: Mar. 22, 2006

(65) Prior Publication Data

US 2006/0239741 A1 Oct. 26, 2006

(30) Foreign Application Priority Data

Apr. 20, 2005 (KR) ..... 10-2005-0032766

(51) Int. Cl.
*B41J 2/38* (2006.01)

(52) U.S. Cl. ..... 347/187

(58) Field of Classification Search ..... 347/197, 347/198, 187, 104; 400/120.16, 120.17
See application file for complete search history.

(56) References Cited

U.S. PATENT DOCUMENTS 6,538,680 B2 3/2003 Sato
2002/0001027 A1* 1/2002 Sugioka et al. ..... 347/104

FOREIGN PATENT DOCUMENTS

| | | |
|---|---|---|
| JP | 04-197670 | 7/1992 |
| JP | 04-301474 | 10/1992 |
| JP | 05-220989 | 3/1993 |
| JP | 05-155100 | 6/1993 |
| JP | 05-212923 | 8/1993 |
| JP | 05-309850 | 11/1993 |
| JP | 2001-080154 | 3/2001 |

* cited by examiner

*Primary Examiner*—K. Feggins
(74) *Attorney, Agent, or Firm*—Roylance, Abrams, Berdo & Goodman, LLP

(57) ABSTRACT

A thermal type image forming apparatus is provided for printing images on both sides of a medium, which are a first surface and a second surface of the medium. A thermal print head (TPH) is rotated about a platen roller to a first position facing the first surface of the medium and to a second position facing the second surface of the medium. The thermal type image forming apparatus includes a transfer unit for transferring the medium in a first direction to supply the medium to a space between the platen roller and the thermal print head and in a second direction substantially opposite to the first direction to perform printing. A control member controls motion of the platen roller in the second direction to align a printing nip formed by the platen roller and the TPH with a heating line of the thermal print head. The platen roller is elastically biased in a direction to contact the control member.

22 Claims, 15 Drawing Sheets

THERMAL TYPE IMAGE FORMING APPARATUS

CROSS-REFERENCE TO RELATED APPLICATIONS

This application claims the benefit under 35 U.S.C. § 119 (a) of Korean Patent Application No. 10-2005-0032766, filed on Apr. 20, 2005, the entire disclosure of which is hereby incorporated by reference.

BACKGROUND OF THE INVENTION

1. Field of the Invention

The present invention relates to an image forming apparatus. More particularly, the present invention relates to a thermal type image forming apparatus that prints images on both sides of a medium.

2. Description of the Related Art

To print images on both sides of a medium, an image forming apparatus includes two thermal printing heads (TPHs) facing both sides of the medium, which are a first surface and a second surface. However, the price of such an image forming apparatus is high. Alternatively, an image forming apparatus including a single TPH that alternately faces the first and second surfaces of the medium may be developed. In this case, the medium may turn over with the TPH fixed so that the first and second surfaces thereof can alternately face the TPH, or the TPH may move to positions that can face the first and second surfaces of the medium.

Accordingly, a need exists for an improved image forming apparatus having a thermal printing head adapted to print on first and second sides of a medium.

SUMMARY OF THE INVENTION

Embodiments of the present invention provide a thermal type image forming apparatus capable of printing images on both sides (first and second sides) of a medium by alternately moving a thermal printing head (TPH) to first and second positions that face the first and second sides, respectively.

Embodiments of the present invention also provide a thermal type image forming apparatus having a heating line of a TPH that may be precisely aligned with a printing nip formed by a platen roller in contact with the TPH when the TPH is located at the first or second position.

According to an aspect of the present invention, a thermal type image forming apparatus prints images on both sides of a medium, which are a first and second surface of the medium. A thermal print head (TPH) is rotated about a platen roller to a first position facing the first surface of the medium and to a second position facing the second surface of the medium. The thermal type image forming apparatus includes a transfer unit and a control member. The transfer unit transfers the medium in a first direction to supply the medium between the platen roller and the thermal print head and in a second direction substantially opposite to the first direction to perform printing. The control member controls a motion of the platen roller in the second direction to align a printing nip formed by the platen roller and the TPH with a heating line of the thermal print head. The platen roller is elastically biased in a direction to contact the control member.

The image forming apparatus further includes a bias member and a pivot unit. The bias member includes a first elastic arm and a second elastic arm and moves between the first and second positions together with the thermal print head. When the thermal print head is located at the first and second positions, the pivot unit pivots the bias member to a third position and a fourth position where the first and second elasatic arms, respectively, push the platen in a direction to contact the control member. The pivot unit includes a pivot protrusion, a pivot member, and a stopper. The pivot member is connected to the bias member to move to the first and second positions together with the thermal print head and pivots the bias member to the third and fourth positions while interfering with the pivot protrusion during the movements to the first and second positions. The stopper locks the pivot member when the bias member is located at the third and fourth positions.

The control member includes a first control position for controlling a motion of the platen roller in the second direction when the thermal print head is located at the first position, and a second control portion for controlling a motion of the platen roller in the second directioni when the thermal print head is located at the second position.

According to another aspect of the present invention, a thermal type image forming apparatus prints images on both sides of a medium, which are first and second surfaces. A thermal print head (TPH) is rotated about a platen roller to a first position facing the first surface of the medium and to a second position facing the second surface of the medium. The thermal type image forming apparatus includes a transfer unit, a control member, a holder, a bias member, a pivot provision, a pivot member, and a stopper. The transfer unit transfers the medium in a first direction to supply the medium to a space between the platen roller and the thermal print head and in a second direction substantially opposite to the first direction to perform printing. The control member rotates together with the thermal print head and includes a first control portion controlling motion of the platen roller in the second direction when the thermal print head is located at the first position and a second control portion controlling motion of the platen roller in the second direction when the thermal print head is located at the second position. The holder moves together with the thermal print head. The bias member includes a first elastic arm and a second elastic arm and is installed pivotably on the holder. The pivot member is connected to the bias member and installed pivotably on the holder and pivots the bias member to a third position and a fourth position, where the first and second elasatic arms, respectively, push the platen roller in a direction to contact the control member while interfering with the pivot protrusion during motions of the thermal print head to the first and second positions. The stopper locks the pivot member when the bias member is located at the third and fourth positions.

The pivot member includes a first arm interfering with the pivot protrusion when the thermal print head moves from the first position to the second position, and a second arm interfering with the pivot protrusion when the thermal print head moves from the second position back to the first position. The pivot member further includes first projections and second projections. The stopper includes elastic arms elastically engaged with the first and second projections when the bias member is located at the third and fourth positions, respectively, to lock the pivot member.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description, such as a detailed construction and elements thereof, are provided to assist in a comprehensive understanding of the exemplary embodiments of the present invention. Accordingly, those of ordinary skill in the art will recognize that various changes and modifications of the exemplary embodiments described herein may be made without departing from the scope and spirit of the invention. Also, descriptions of well-known functions and constructions are omitted for clarity and conciseness.

Figure 1:
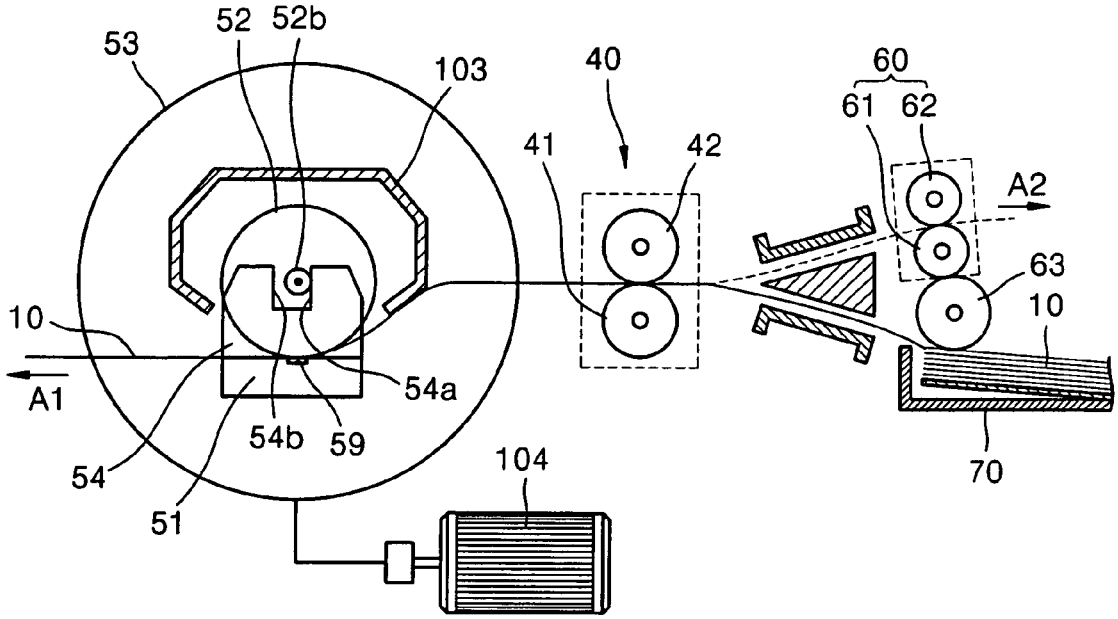
FIGS. 1 and 2 are schematic diagrams of a thermal type image forming apparatus according to an exemplary embodiment of the present invention.
Figure 2:
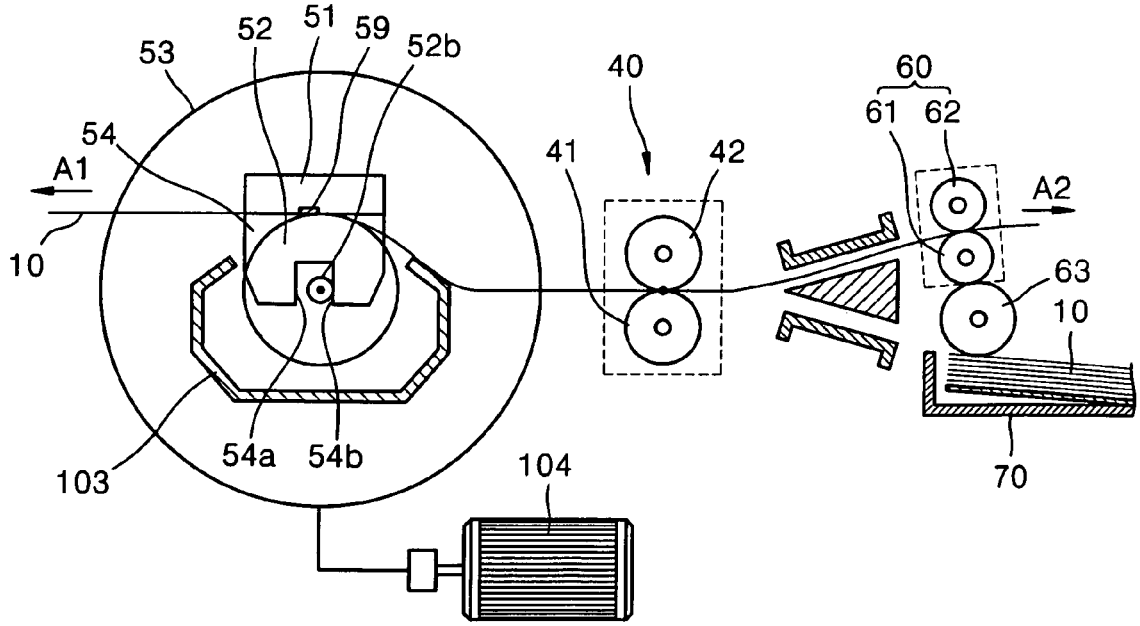

FIGS. 1 and 2 illustrate a schematic structure of an image forming apparatus according to an exemplary embodiment of the present invention. Referring to FIGS. 1 and 2, the image forming apparatus includes a thermal printing head (TPH) 51 and a platen roller 52. The platen roller 52 faces the TPH 51, supports a medium 10, and forms printing nips. The TPH 51 rotates about the platen roller 52 to move to either a first position (illustrated in FIG. 1) or a second position (illustrated in FIG. 2), which face first and second surfaces, respectively, of the medium 10. The TPH 51 is coupled to support brackets 53. When the support brackets 53 are rotated by a motor 104, the TPH 51 rotates about the platen roller 52 and moves to either the first or second position.

A transfer unit 40 transfers the medium 10. The medium 10 is picked up from a cassette 70 by a pickup roller 63 and is transferred in a first direction A1 by the transfer roller 40 to reach a printing nip between the TPH 51 and the platen roller 52. When the medium 10 is located at a print start position, the transfer roller 40 transfers the medium 10 in a second direction A2. The TPH 51 heats the first surface of the medium 10 to print an image on the first surface of the medium 10. A discharge unit 60 temporarily discharges the medium 10 on which the first surface has been printed with an image. When the medium 10 escapes from the printing nip between the TPH 51 and the platen roller 52, the transfer unit 40 stops transferring the medium 10. The motor 104 moves the TPH 51 to the second position by rotating the support brackets 53. The transfer roller 40 transfers the medium 10 back in the first direction A1 so that the medium 10 is supplied to the printing nip between the TPH 51 and the platen roller 52. The second surface of the medium 10 faces the TPH 51. When the medium 10 is located at the print start position, the transfer roller 40 transfers the medium 10 in second direction A2. The TPH 51 prints an image on the second surface of the medium 10 by heating the second surface. The discharge unit 60 discharges the medium 10 on which both surfaces have been printed with images.

Figure 9:
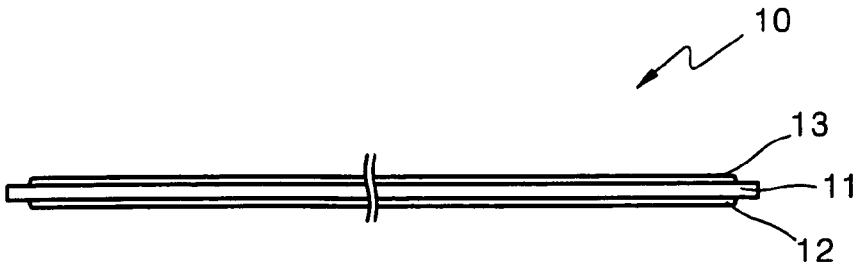
FIG. 9 is a cross-section of an exemplary medium used in the thermal type image forming apparatus according to the exemplary embodiment of FIGS. 1 and 2.

The medium 10 may have a structure as illustrated in FIG. 9. Referring to FIG. 9, ink layers 12 and 13 with predetermined colors are formed on both surfaces of a base sheet 11, which are first and second surfaces, respectively. The ink layers 12 and 13 may include a single layer for representing a single color, or multiple layers for representing two or more colors. For example, the ink layer 12 on the first surface of the base sheet 11 may be formed of two layers to express the colors yellow (Y) and magenta (M), and the ink layer 13 on the second surface thereof may be formed of a single layer to express the color cyan (C). The ink layers 12 and 13 may represent identical colors. The technical scope of the image forming apparatus illustrated in FIGS. 1 and 2, which is capable of printing images on both surfaces of the medium 10 using the single TPH 51, is not limited to the structure of the medium 10 having the first and second surfaces on which ink layers are formed.

The base sheet 11 may be transparent. An opaque layer may be formed on one of the ink layers 12 and 13, for example, the ink layer 12. The TPH 51 is located at the first position and prints images with Y and M colors by heating the ink layer 12. The TPH 51 is located at the second position and prints an image with a C color by heating the ink layer 13. A complete color image in which the Y, M, and C color images overlap may be recognized when the image is viewed from the side of the base sheet 11 on which the ink layer 13 is formed.

The thermal type image forming apparatus according to the exemplary embodiment illustrated in FIGS. 1 and 2 may be used to perform double-sided printing. When the base sheet 11 is opaque, double-sided printing is possible by printing different images on the first and second surfaces of the medium 10.

Figure 3:
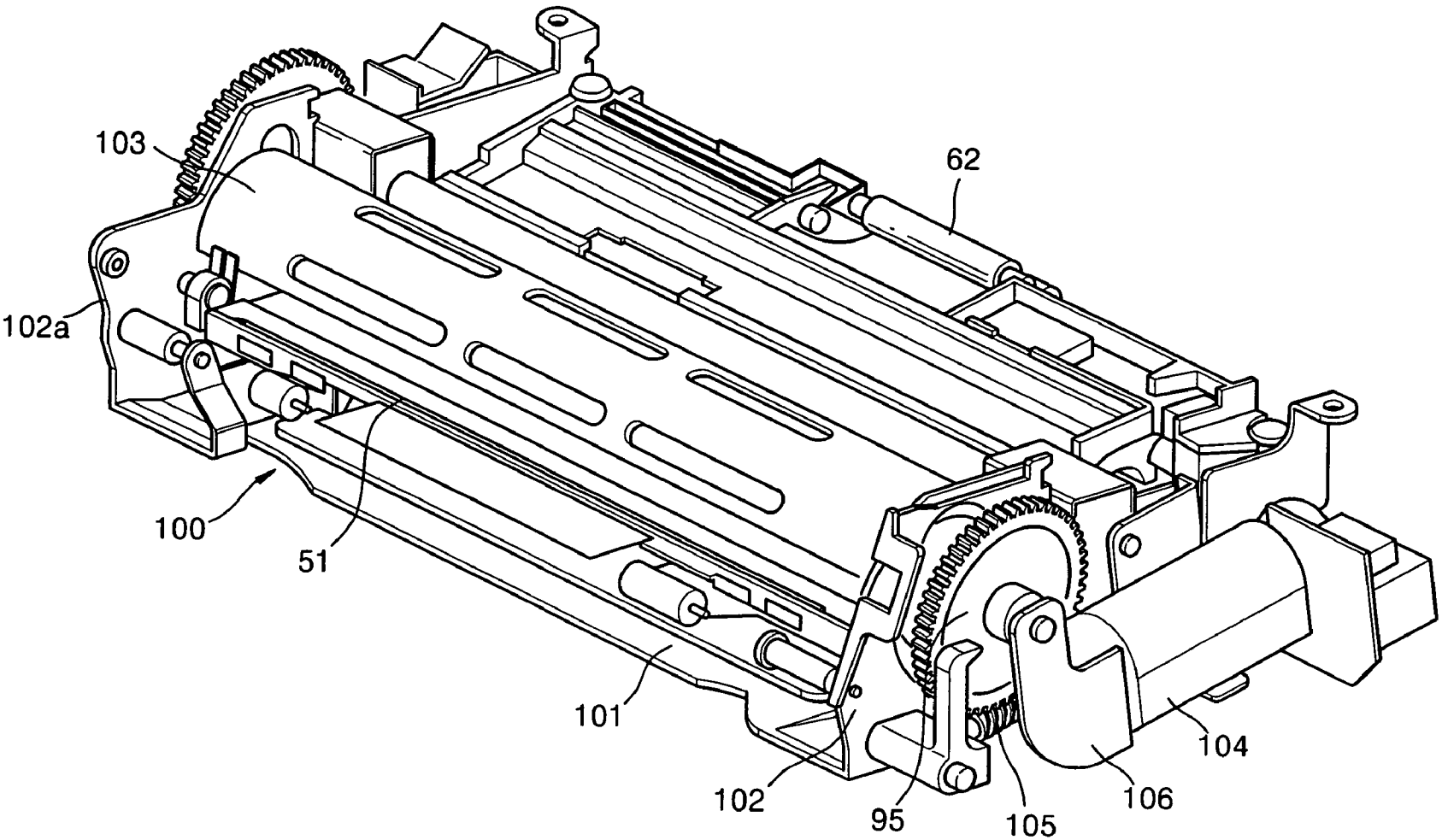
FIGS. 3 and 4 are a perspective view and an exploded perspective view, respectively, of the thermal type image forming apparatus of FIGS. 1 and 2.
Figure 4:
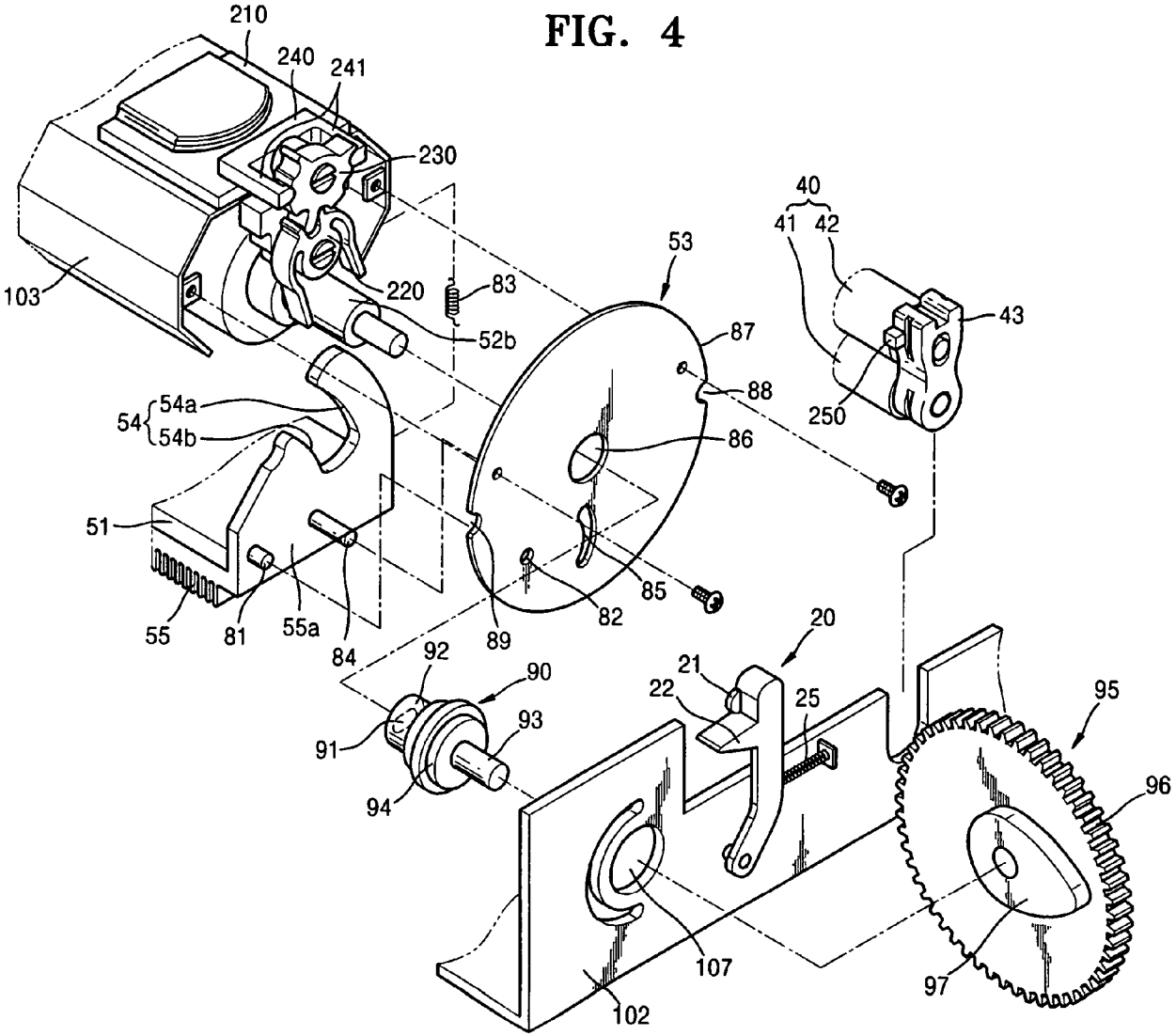

FIG. 3 is a perspective view of the thermal type image forming apparatus of FIGS. 1 and 2. FIG. 4 is an exploded perspective view of a structure for moving the TPH 51 between the first and second positions. The structure for moving the TPH 51 between the first and second positions is described in greater detail with reference to FIGS. 3 and 4.

Referring to FIGS. 3 and 4, a frame 100 includes a bottom base 101, and two lateral plates 102 and 102*a* extending upwardly from both lateral sides of the bottom base 101. The cassette 70, in which the medium 10 is contained, is arranged on a side of the frame 100. The pickup roller 63 for picking up the medium 10 from the cassette 70 is arranged over the cassette 70 on the frame 100. The discharge unit 60, which includes a discharge roller 61 and an idle roller 62 engaging with the discharge roller 61, is arranged on the pickup roller 63 to discharge a medium 10 on which an image has been printed. In the present exemplary embodiment, the discharge roller 61 and the pickup roller 63 contact each other and are driven by a single driving motor (not shown). The driving motor may be connected to the lateral plate 102*a*. The TPH 51 and the platen roller 52 are arranged opposite to the discharge unit 60 between the two lateral plates 102 and 102*a*. The medium 10 is transferred by the transfer unit 40. The transfer unit 40 includes a pair of rollers 41 and 42 that elastically engage each other. A rotating force of the driving motor is transmitted to one of the rollers 41 and 42, and the other roller is preferably driven by the driven roller.

Bushings 90 and 90*a* (see FIGS. 5 and 6) are coupled to the two lateral plates 102 and 102*a*, respectively. Each of the bushings 90 and 90*a* includes an inner circumferential portion 91 and a first outer circumferential portion 92. Both ends of the platen roller 52 are inserted into the inner circumferential portions 91 of the bushings 90 and 90*a*. A pair of support brackets 53 are rotatably coupled to the first outer circumferential portions 92 of the bushings 90 and 90*a* (only the bushing 90 and only one of the support brackets 53 are shown in FIG. 4).

A heat sink 55 for discharging heat from the TPH 51 is coupled to the TPH 51. Hinge shafts 81 formed on both lateral portions 55*a* of the heat sink 55 are inserted into hinge holes 82 formed in the two support brackets 53. The TPH 51 is coupled to the support brackets 53 to rotate on the hinge holes 82. A rotation guide 103 is coupled to the support brackets 53. The rotation guide 103 guides a medium 10 transferred by the transfer unit 40 to be located between the TPH 51 and the platen roller 52. The TPH 51 is elastically biased by an elastic member 83 in such a direction to contact the platen roller 52. For example, as shown in FIG. 4, the elastic member 83 may be a tensile coil spring having one end connected to the TPH 51 and the other end connected to the rotation guide 103, which covers the platen roller 52.

A shaft 84 formed on a lateral portion 55*a* of the heat sink 55 is inserted in a through hole 85 formed in the support bracket 53. The through hole 85 is preferably arcuately shaped around the hinge hole 82 to allow the TPH 51 to contact and separate from the platen roller 52. In an exemplary embodiment, the platen roller 52 is not connected to a driving motor (not shown). However, the platen roller 52, which is in contact with the medium 10 that is transferred by the transfer unit 40, is rotated by the medium 10.

The bushing 90 further includes a second outer circumferential portion 93 that is substantially concentric with the first outer circumferential portion 92. A rotating cam 95 is rotatably combined with the second outer circumferential portion 93. The rotating cam 95 includes a gear portion 96 and a cam portion 97 that contacts the shaft 84. Referring back to FIG. 3, the motor 104 has a worm gear 105 that engages the gear portion 96. A bracket 106, to which the motor 104 is coupled, is combined with the lateral plate 102. Referring to FIG. 4, the bushing 90 further includes a third outer circumferential portion 94, which is inserted into a hole 107 formed in the lateral plate 102, and the end of the second outer circumferential portion 93 is supported by the bracket 106. The bracket 106 prevents the rotating cams 95 from being detached from the second outer circumferential portions 93 at the two lateral plates 102 and 102*a*. The bushing 90*a* of FIG. 5, which is coupled to the lateral plate 102*a*, includes the inner circumferential portion 91 and the first and third outer circumferential portions 92 and 94. The support brackets 53 and the rotating cam 95 are rotated on the same rotating axis, and the TPH 51 is also rotated on the same rotating axis. The support bracket 53 has a circular circumference 87. First and second engagement grooves 88 and 89 are formed and separated from each other by approximately 180 degrees along the circumference 87. A locking member 20 is rotatably combined with the lateral plate 102. An elastic member 25 applies an elastic force to the locking member 20 in a direction so that the locking member 20 engages the first or second engagement groove 88 or 89. The locking member 20 is releasable from the first and second engagement grooves 88 and 89 by the rotating cam 95, and engages the first or second engagement grooves 88 or 89 by the elastic force of the elastic member 25. The locking member 20 includes a protrusion 21 insertable in the first or second engagement grooves 88 or 89 and an interfering portion 22 that interferes with the cam portion 97 of the rotating cam 95.

Figure 5:
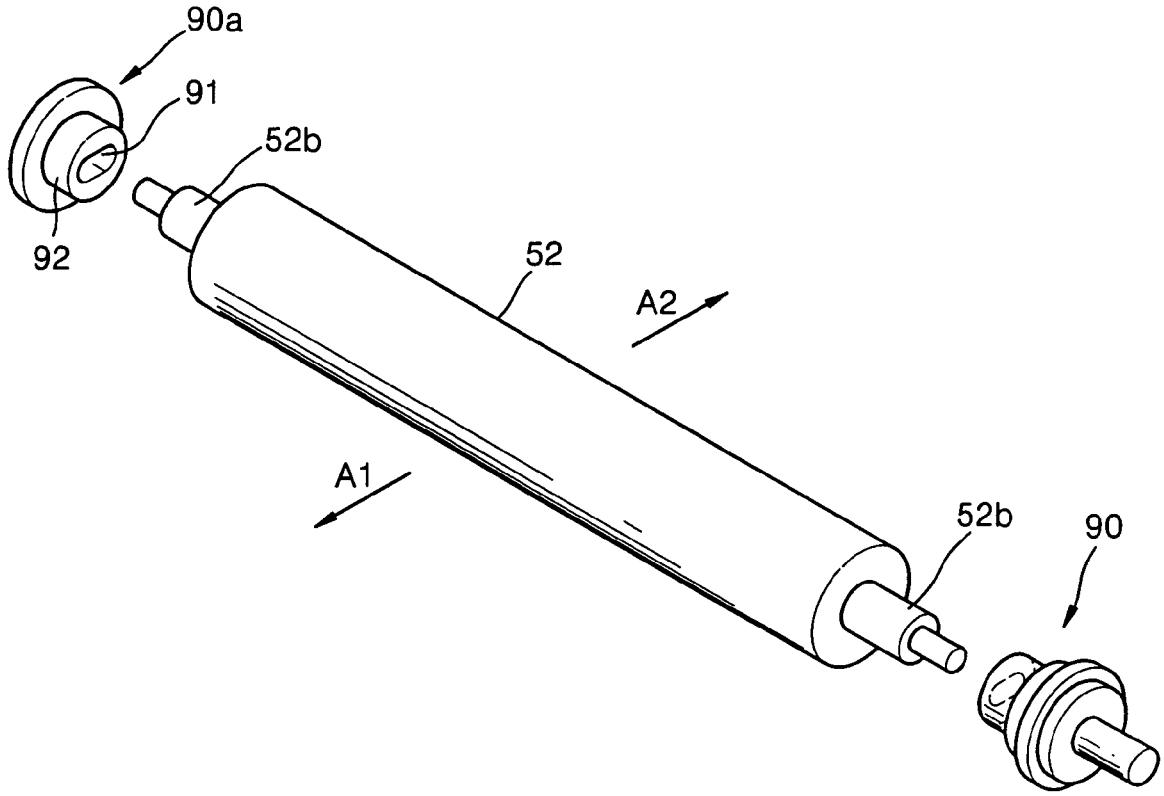
FIG. 5 is an exploded perspective view of a bushing of FIG. 4.
Figure 6:
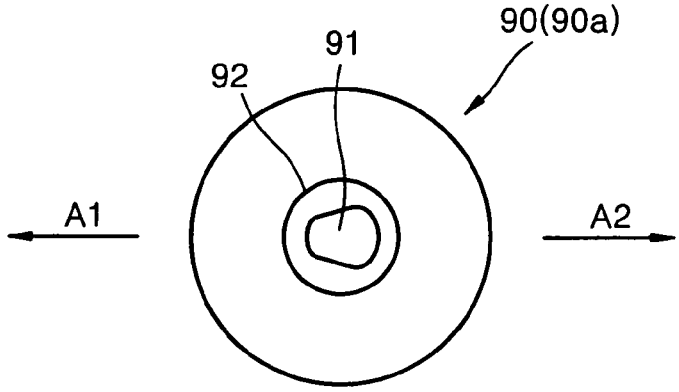
FIG. 6 is a side elevational view of a modification of the bushing of FIG. 4.

Referring to FIGS. 1 and 2, heating lines 59 are aligned with the printing nips, which correspond to a contact portion between the TPH 51 and the platen roller 52 and are formed by the platen roller 52, to effectively heat the medium 10. To align the heating lines 59 and the printing nips, the thermal type image forming apparatus includes a control member 54. Referring to FIG. 4, the control member 54 includes a first control portion 54*a*, which contacts an end portion 52*b* of the platen roller 52 when the TPH 51 is located at the first position, and a second control portion 54*b*, which contacts the end portion 52*b* of the platen roller 52 when the TPH 51 is located at the second position. The first and second control portions 54*a* and 54*b* are formed in both lateral portions 55*a* of the heat sink 55. Moreover, the first and second control portions 54*a* and 54*b* are preferably arcuately shaped around the hinge hole 82. The integration of the control member 54 into the heat sink 55 reduces the number of components and simplifies a manufacturing process. As shown in FIG. 5, both ends of the platen roller 52 are inserted in the inner circumferential portions 91 of the bushings 90 and 90*a* and rotatably supported by the bushings 90 and 90*a*. The inner circumferential portions 91 of the bushings 90 and 90*a* are preferably elongated in the first and second directions A1 and A2. As shown in FIG. 6, the inner circumferential portions 91 of the bushings 90 and 90*a* may preferably be elongated to be wider in the second direction A2.

While the medium 10 is being transferred in the second direction A2, the platen roller 52 tends to be pulled in the second direction A2. Accordingly, the first and second control portions 54*a* and 54*b* control motion of the platen roller 52 in the second direction A2. Referring to FIG. 1, the TPH 51 is located at the first position. The first control portion 54*a* is located on a side of the end portion 52*b* of the platen roller 52 that faces the second direction A2, and controls the platen roller 52 not to move excessively in the second direction A2 along the inner circumferential portions 91 of the bushings 90 and 90*a*, thereby aligning the heating lines 59 of the TPH 51 with the printing nips. Referring to FIG. 2, the TPH 51 is located at the second position. The second control portion 54*b* is located on the side of the end portion 52*b* of the platen roller 52 that faces the second direction A2, and controls the platen roller 52 not to move excessively in the second direction A2 along the inner circumferential portions 91 of the bushings 90 and 90*a*, thereby aligning the heating lines 59 of the TPH 51 with the printing nips. Due to this alignment, thermal energy provided by each of the heating lines 59 is stably transmitted to the medium 10 to thus achieve stable printing.

In conventional image forming apparatuses, when frictions between inner circumferential portions 91 of the bushings 90 and 90*a* and both ends of the platen roller 52 increase, the platen roller 52 may not be properly pulled in the second direction A2. Moreover, depending on installing conditions, such as, handing of an image forming apparatus on the wall, the weight of the platen roller 52 hinders a motion of the platen roller 52 in the second direction A2. Then, the heating lines 59 and the printing nips are misaligned, which hinders the formation of a stable image. Furthermore, when such a conventional image forming apparatus is used in a moving vehicle, the heating lines 59 and the printing nips may be misaligned by a vibration of the vehicle, or other similar movements. To solve this problem, the thermal type image forming apparatus according to an exemplary embodiment is constructed so that the platen roller 52 may be elastically biased in a direction to contact the control member 54, that is, in the second direction A2.

Figure 7:
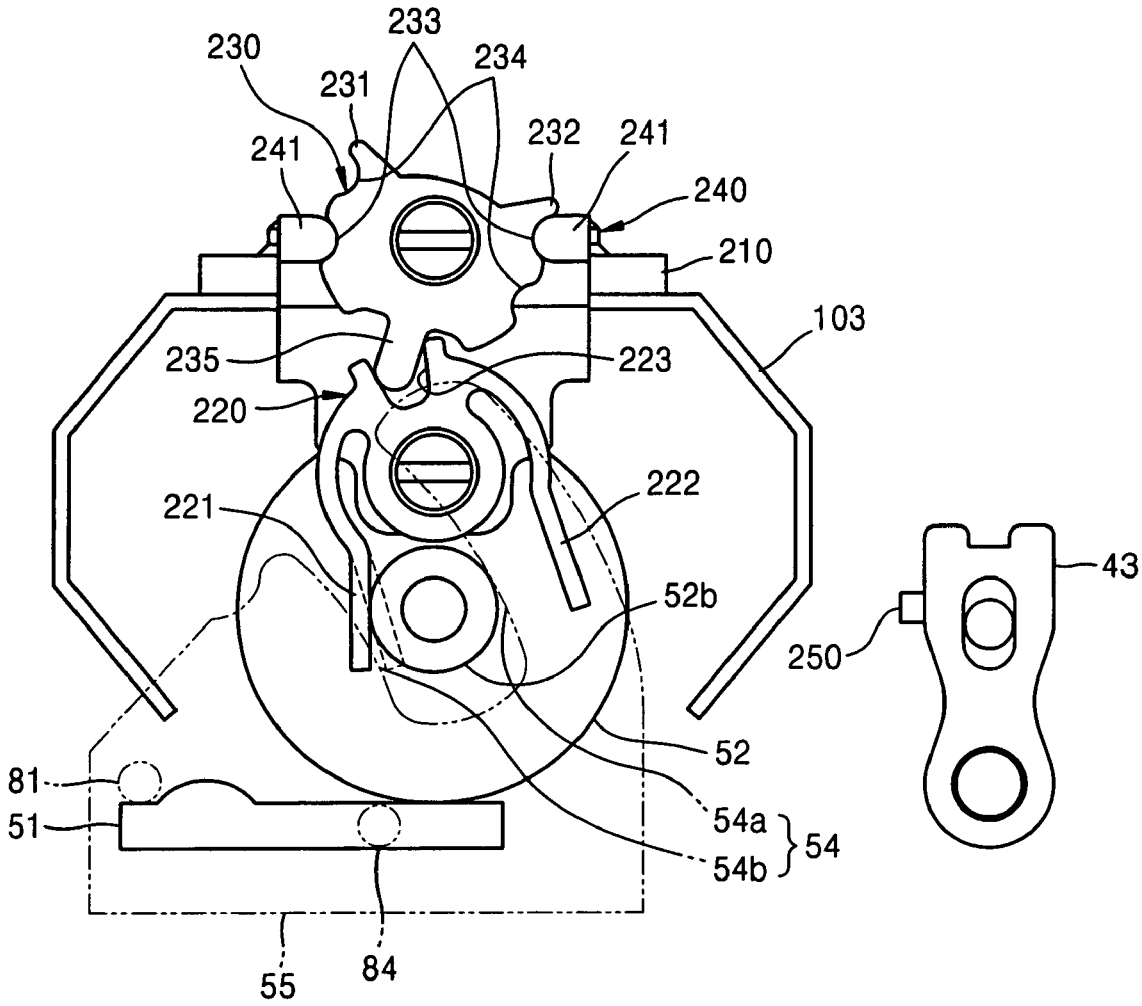
FIG. 7 is a side elevational view of a biasing member located at a third position.
Figure 8:
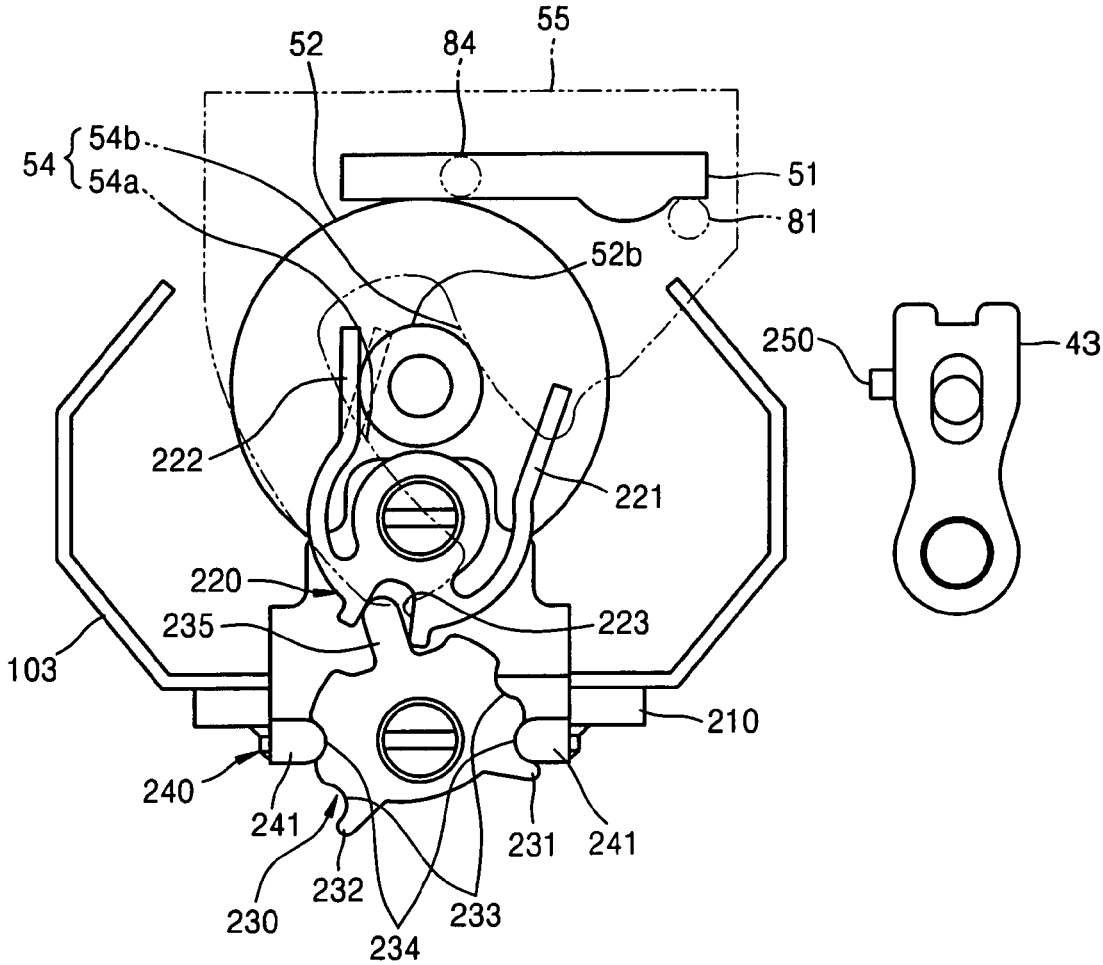
FIG. 8 is a side elevational view of the biasing member located at a fourth position.

Referring to FIGS. 4, 7, and 8, the thermal type image forming apparatus includes a bias member 220 to elastically bias the platen roller 52 in a direction to contact the control member 54. In an exemplary embodiment, a holder 210 is coupled to the rotating guide 103, and the bias member 220 is installed to be pivotable on the holder 210. The bias member 220 is moved to the first and second positions together with the TPH 51. The bias member 220 is pivoted to third and fourth positions when the TPH 51 is located at the first and second positions, respectively, to elastically bias the platen roller 52 in the second direction A2. The bias member 220 includes a first elastic arm 221 and a second elastic arm 222. When the bias member 220 is located at the third position (as illustrated in FIG. 7), the first elastic arm 221 pushes the platen roller 52 in the second direction A2. When the bias member 220 is located at the fourth position (as illustrated in FIG. 8), the second elastic arm 222 pushes the platen roller 52 in the second direction A2. The thermal type image forming apparatus according to an exemplary embodiment includes a pivot unit for pivoting the bias member 220 to the third and fourth positions.

The pivot unit includes a pivot member 230 and a pivot protrusion 250. The pivot member 230 is pivotably coupled to the holder 210. Hence, the bias member 220 and the pivot member 230 are moved to the first and second positions together with the TPH 51. The bias member 220 includes a concave portion 223. The pivot member 230 includes a protrusion 235 adapted to fit into the concave portion 223. The pivot member 230 further includes a first arm 231 and a second arm 232. The pivot protrusion 250 interferes with the first arm 231 when the TPH 51 rotates from the first position to the second position. The pivot protrusion 250 interferes with the second arm 232 when the TPH 51 rotates from the second position back to the first position. The pivot protrusion 250 is installed on a support member 43, which is coupled to the lateral plates 102 and 102*a* to support the transfer unit 40. The pivot unit further includes a stopper 240 for locking the pivot member 230. The stopper 240 includes elastic arms 241. When the bias member 220 is located at the third position, the elastic arms 241 are coupled to first projections 233 of the pivot member 230, so that the pivot member 230 is locked in the stopper 240. When the bias member 220 is located at the fourth position, the elastic arms 241 are coupled to second projections 234 of the pivot member 230, so that the pivot member 230 is locked in the stopper 240. The stopper 240 may be incorporated into the holder 210 or coupled to the holder 210.

FIGS. 10A through 10I illustrate movement of the TPH 51 between the first and second positions. FIGS. 11A through 11D illustrate a method of pivoting the bias member. 220 between third and fourth positions.

Figure 10A:
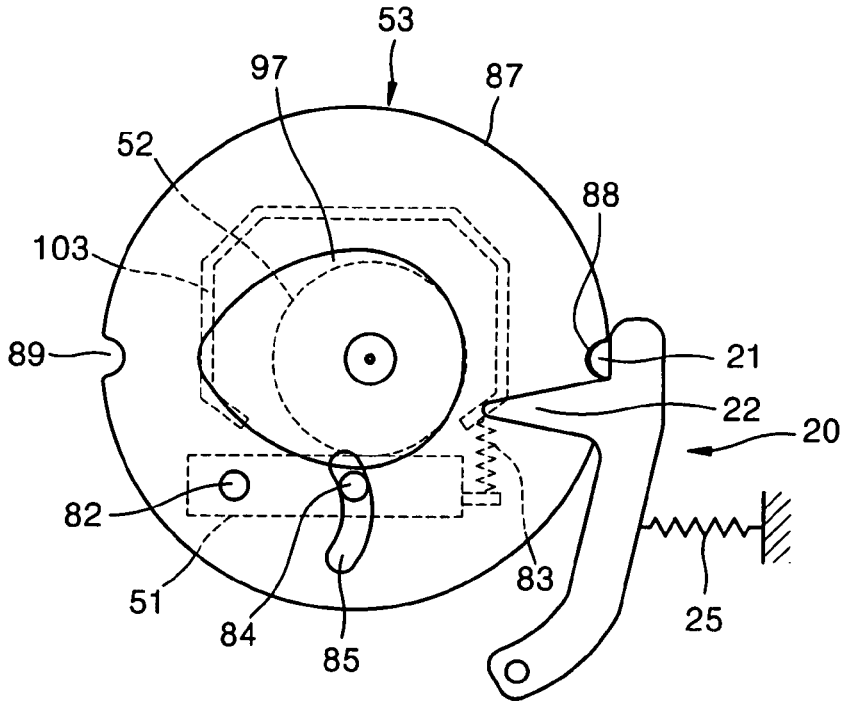
FIGS. 10A through 10I illustrate a method of moving a thermal print head (TPH) between first and second positions.

As shown in FIG. 10A, the TPH 51 contacts the platen roller 52. The protrusion 21 of the locking member 20 engages the first engagement groove 88, so that the TPH 51 is locked at the first position. The medium 10, withdrawn from the cassette 70 by the pickup roller 63, is transferred to the transfer unit 40. Preferably, the TPH 51 separates from the platen roller 52 before the medium 10 enters between the TPH 51 and the platen roller 52.

Figure 10B:
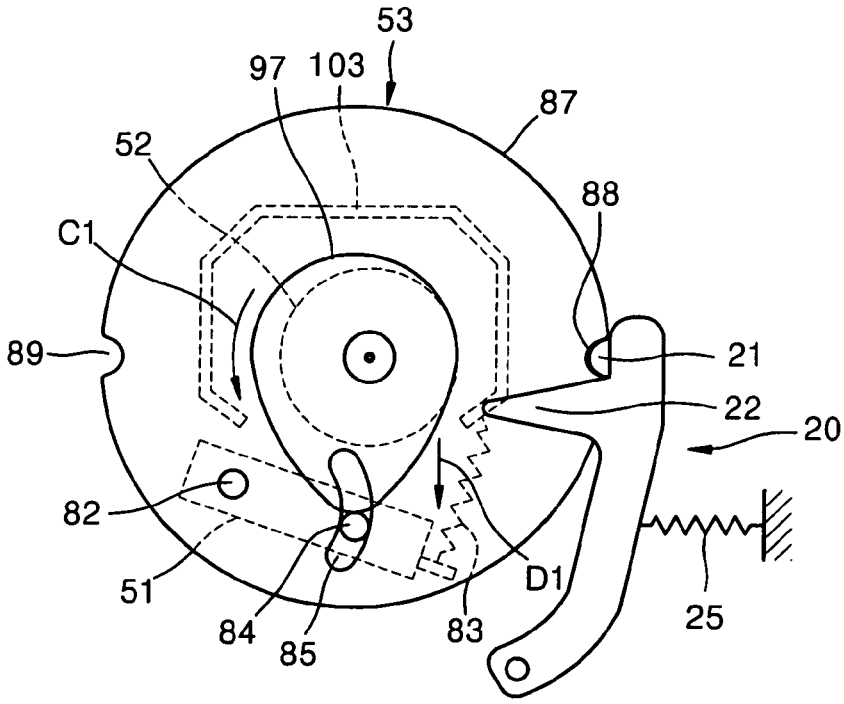

Referring to FIG. 10B, the rotating cam 95 is rotated in direction C1, and the cam portion 97 pushes the shaft 84. Because the protrusion 21 of the locking member 20 engages the first engagement groove 88, rotation of each support bracket 53 is prevented. While the shaft 84 is being pushed in direction D1 along the through hole 85, the TPH 51 is rotated on the hinge hole 82 to be separated from the platen roller 52. At this time, the TPH 51 may be rotated without interruption of the end portion 52*b* because the first and second control portions 54*a* and 54*b* are arcuately shaped around the hinge hole 82. The transfer unit 40 transfers the medium 10 in the first direction A1 so that the medium 10 may enter between the TPH 51 and the platen roller 52. Because the TPH 51 and the platen roller 52 are separated from each other, the medium 10 enters between the TPH 51 and the platen roller 52 without resistance even when the platen roller 52 does not rotate. After the medium 10 enters between the TPH 51 and the platen roller 52, the transfer unit 40 is stopped.

Figure 10C:
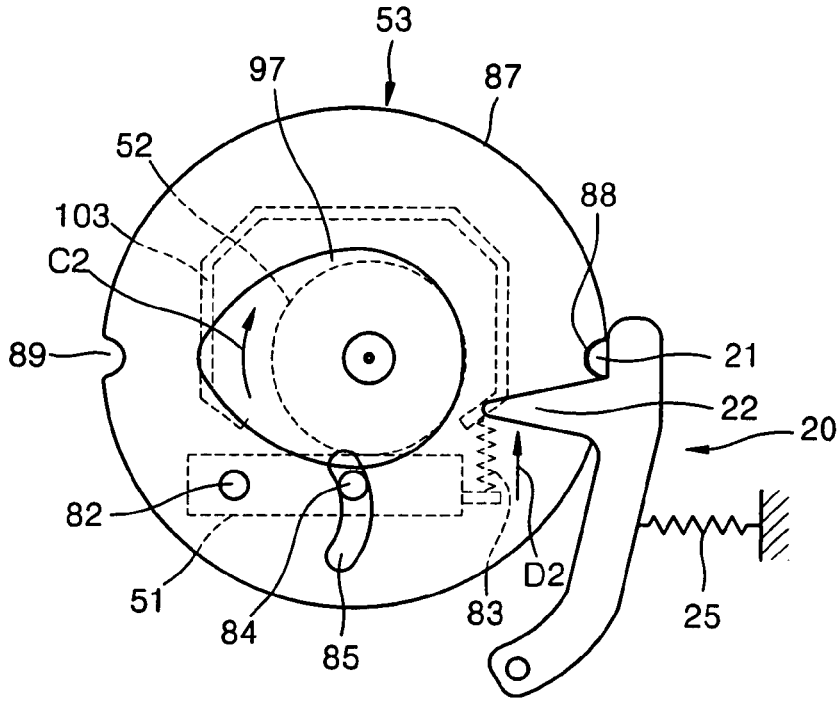

As shown in FIG. 10C, the rotating cam 95 is rotated in direction C2. Because the protrusion 21 of the locking member 20 is engaged with the first engagement groove 88, rotation of each support bracket 53 is prevented. The TPH 51 is rotated on the hinge hole 82 in direction D2 by the elastic force of the elastic member 83 to elastically contact the platen roller 52.

The transfer unit 40 starts transferring the medium 10 in the second direction A2. The platen roller 52 is led in the second direction A2 due to a friction with the medium 10. Also, as shown in FIG. 7, the bias member 220 is located at the third position so that the first elastic arm 221 pushes the platen roller 52 in the second direction A2. Hence, the platen roller 52 moves in the second direction A2 along the slot-shaped inner circumferential portions 91 of the bushings 90 and 90*a*. When each end 52*b* of the platen roller 52 contacts the first control portion 54*a*, movement of the platen roller 52 is stopped. Accordingly, the heating line 59 of the TPH 51 is aligned with the printing nip formed by the platen roller 52. The TPH 51 heats the first surface of the medium 10 to print images with M and Y colors on the first surface. Either the Y or M color is represented depending on a temperature or a heating duration of the TPH 51. For example, if the TPH 51 heats the ink layer 12 at a high temperature for a short period of time, the Y color may be emitted. If the TPH 51 heats the ink layer 12 at a low temperature for a long period of time, the M color may be emitted. The discharge roller 60 temporarily discharges the medium 10 on which the first surface has been printed with an image. When the image printing on the first surface of the medium 10 is complete, the transfer roller 40 stops.

Figure 10D:
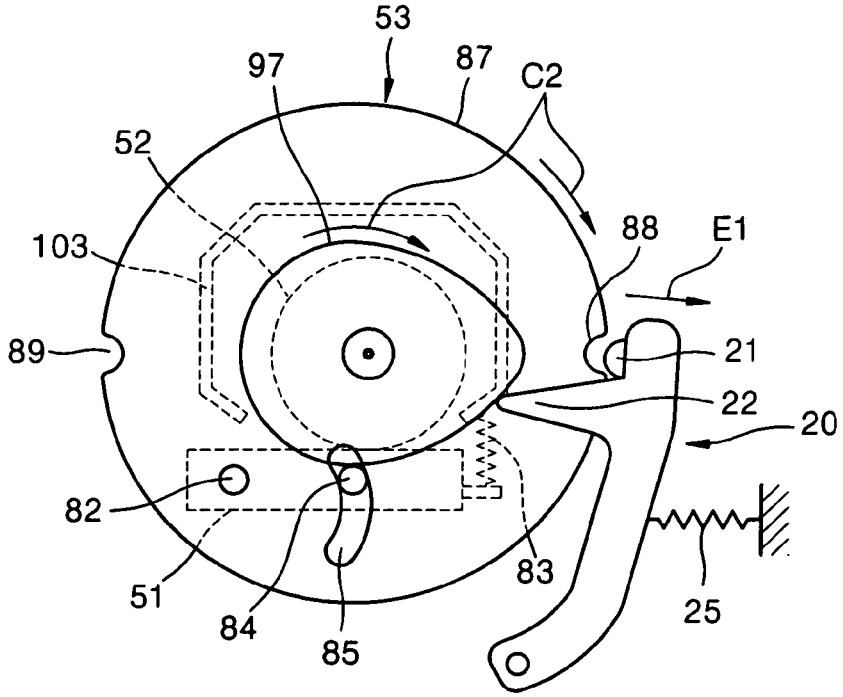
Figure 10E:
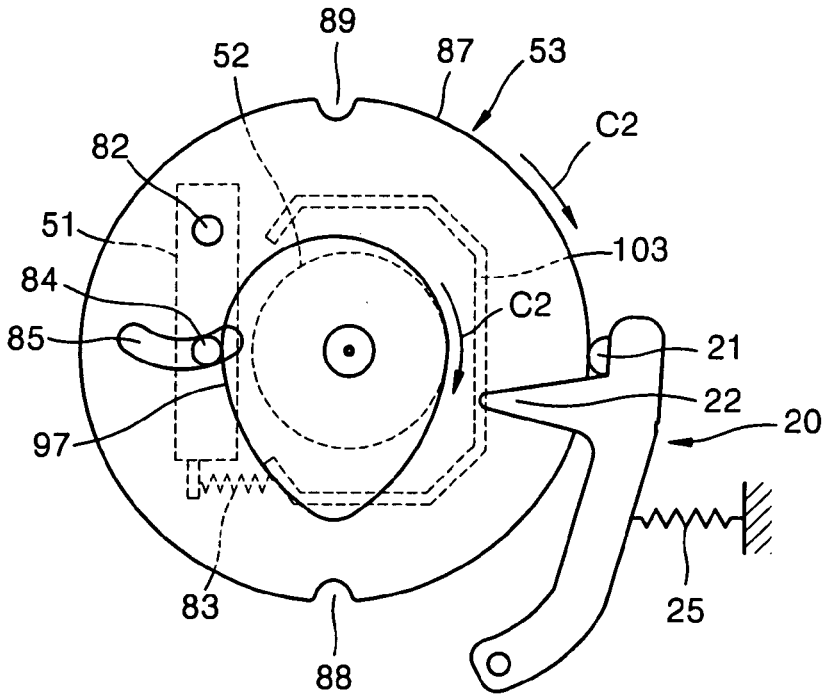

To print an image on the second surface of the medium 10, the transfer of the TPH 51 to the second position is performed. Referring to FIG. 10D, when the rotating cam 95 is rotated in direction C2, the cam portion 97 pushes the interfering portion 22 and rotates the locking member 20 in direction E1. Then, the protrusion 21 comes out of the first engagement groove 88 and releases each of the support brackets 53. Thus, the support brackets 53 may be freely rotated. Hence, when the rotating cam 95 continues to rotate in direction C2 and the cam portion 97 pushes the shaft 84, each of the support brackets 53 rotates about a rotating shaft 52*a* of the platen roller 52 in direction C2 as shown in FIG. 10E, instead of the TPH 51 separating from the platen roller 52 in direction D1. While the support brackets 53 are rotating in direction C2, the TPH 51 may slightly separate from the platen roller 52 because the cam portion 97 pushes the shaft 84. When contact between the cam portion 97 and the interfering portion 22 ends, the locking member 20 continuously contacts the outer circumference 87 of each of the support brackets 53 due to an elastic force of the elastic member 25.

Figure 10F:
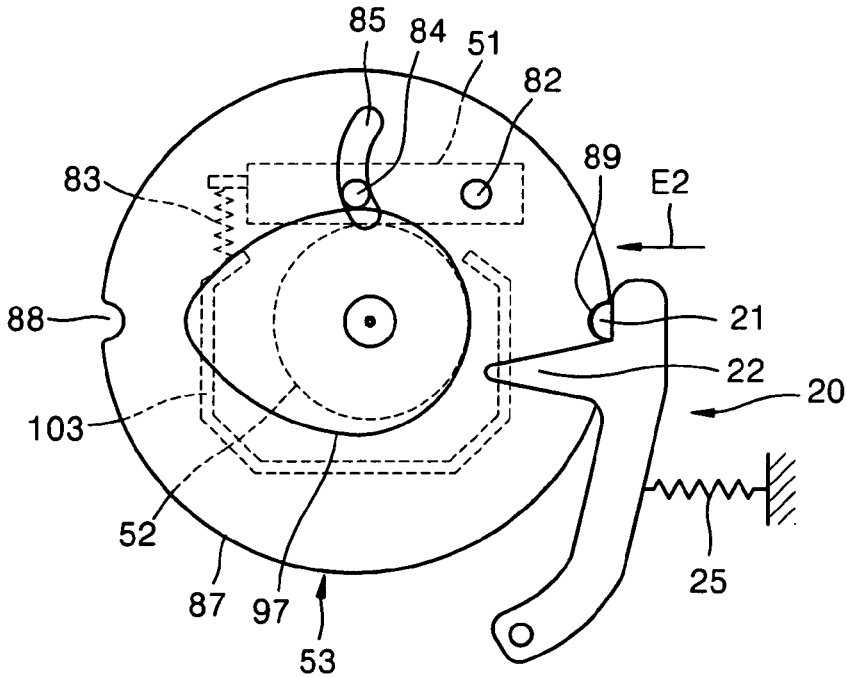

As shown in FIG. 10F, when each of the support brackets 53 rotates 180 degrees, the locking member 20 rotates in direction E2 by an elastic force of the elastic member 25.

Thus, the protrusion 21 is inserted in the second engagement groove 89 and each of the support brackets 53 is locked and cannot be rotated further. The TPH 51 reaches the second position facing the second surface of the medium 10.

Figure 11A:
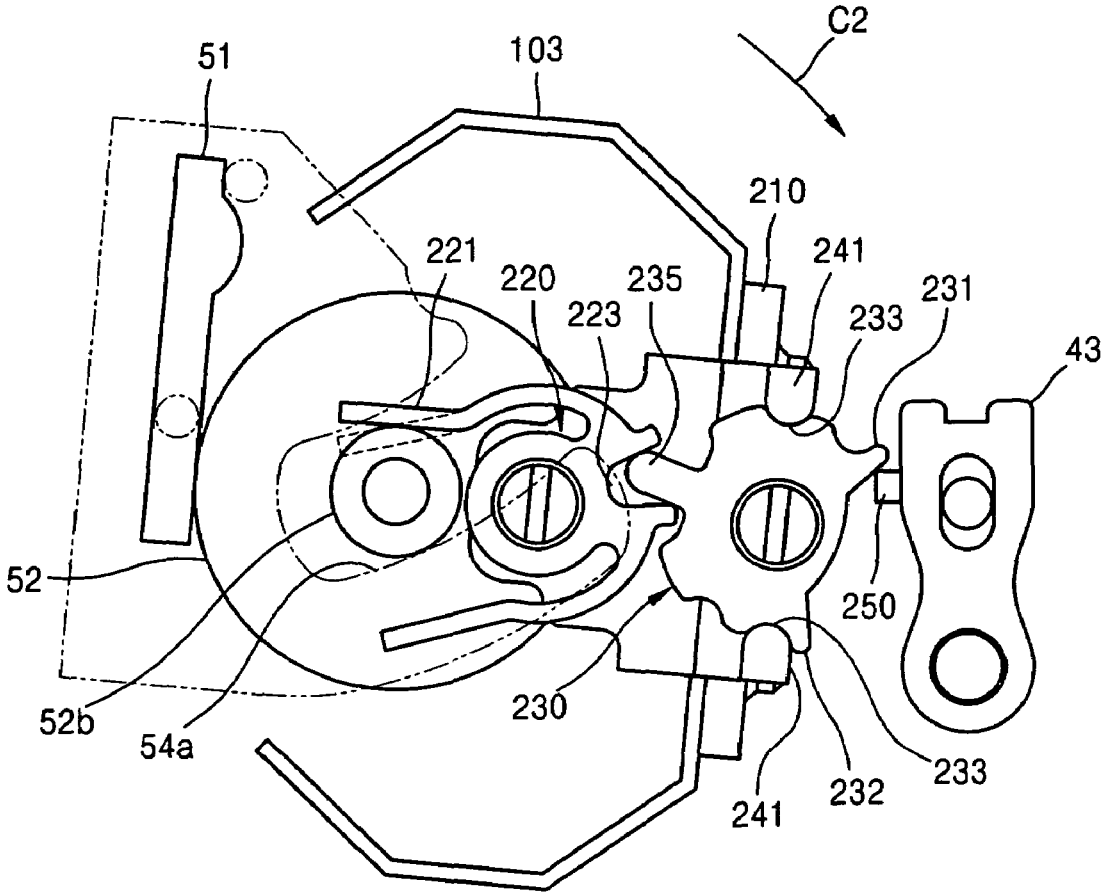
FIGS. 11A through 11D illustrate a method of pivoting a biasing member between third and fourth positions.
Figure 11B:
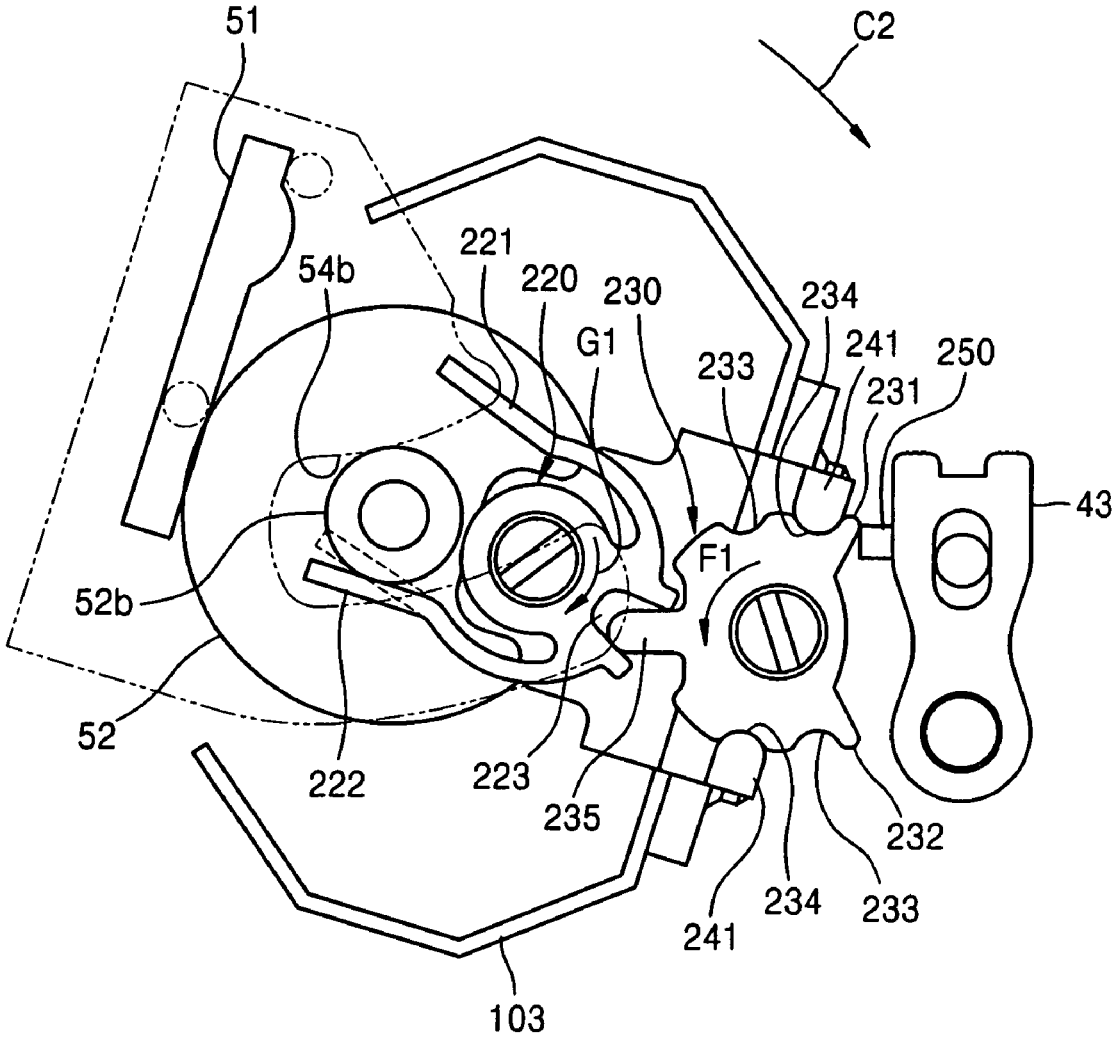

At this time, as shown in FIG. 11A, the first arm 231 of the pivot member 230 interferes with the pivot protrusion 250. As shown in FIG. 11B, the elastic arms 241 are elastically deformed and released from the first projections 233, and the pivot member 230 pivots in direction F1. At this time, the protrusion 235 pushes the concave portion 223, and the bias member 220 pivots in direction G1 to reach the fourth position as shown in FIG. 8. The elastic arms 241 are engaged with the second projections 234 to lock the pivot member 230. When the TPH 51 reaches the second position, the second elastic arm 222 of the bias member 220 pushes the platen roller 52 in the second direction A2.

Figure 10G:
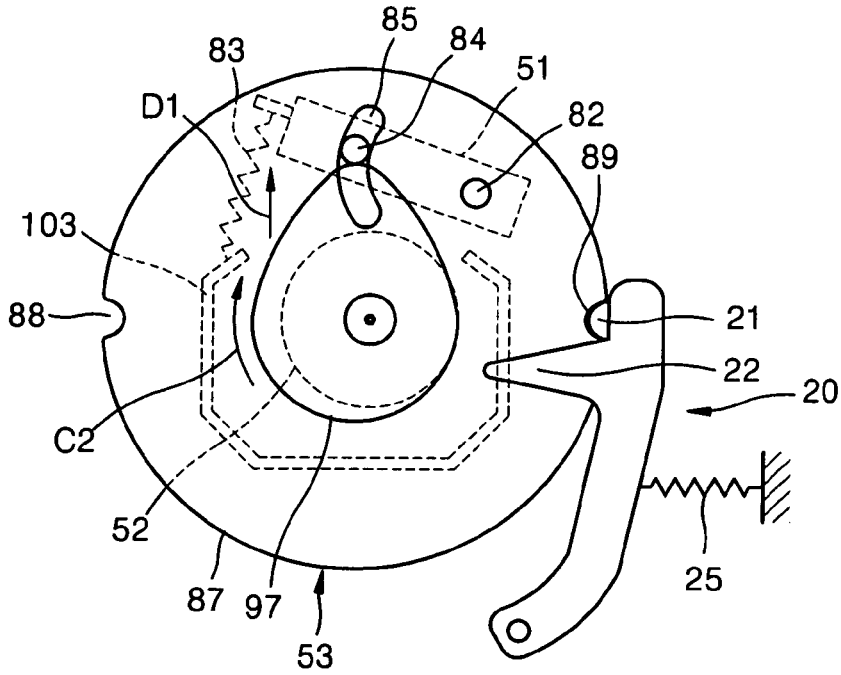

As shown in FIG. 10G, when the rotating cam 95 continuously rotates in direction C2, rotation of each of the support brackets 53 is prevented because the protrusion 21 engages the second engagement groove 89. Instead, the TPH 51 is detached from the platen roller 52 while the shaft 84 is being pushed up along the through hole 85.

Figure 10H:
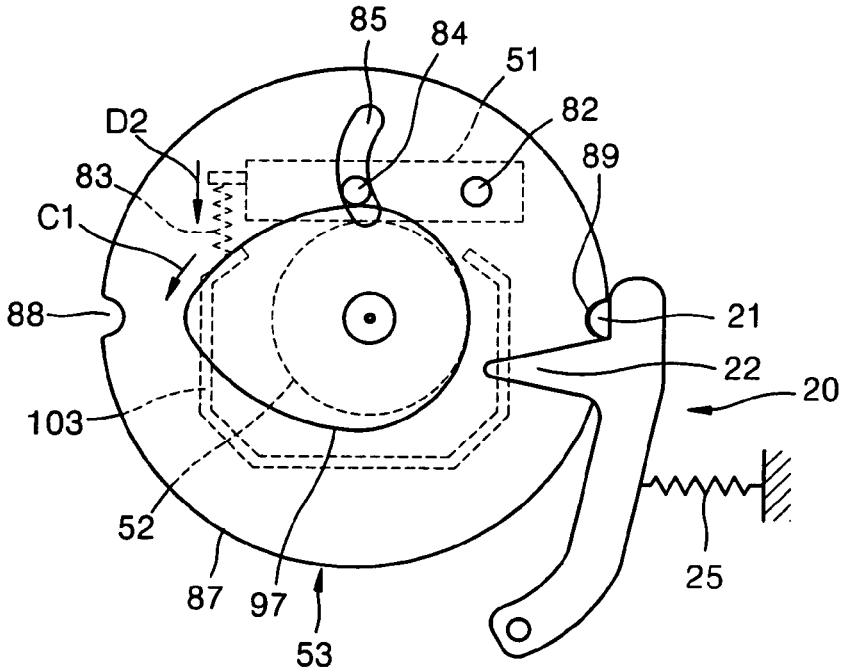

In this state, the transfer unit 40 moves the medium 10 in the first direction A1 to supply the medium 10 to the space between the TPH 51 and the platen roller 52, and then stops. Referring to FIG. 10H, when the rotating cam 95 rotates in direction C1, rotation of each of the support brackets 53 is prevented because the protrusion 21 engages the second engagement groove 89. Instead, the TPH 51 comes into contact with the platen roller 52 while the shaft 84 is retreating along the through hole 85.

The transfer unit 40 transfers the medium 10 back in the second direction A2. The platen roller 52 is led in the second direction A2 due to a friction with the medium 10. Also, as shown in FIG. 8, the second elastic arm 222 of the elastic member 220 pushes the platen roller 52 in the second direction A2. Hence, the platen roller 52 moves in the second direction A2 along the slot-shaped inner circumferential portions 91 of the bushings 90 and 90*a*. When each end 52*b* of the platen roller 52 contacts the second control portion 54*b*, movement of the platen roller 52 is stopped. Accordingly, the heating line 59 of the TPH 51 is aligned with the printing nip formed by the platen roller 52. The TPH 51 heats the second surface of the medium 10 to print an image with a C color on the second surface. The medium 10 on which first and second surface have been printed with images is discharged from the image forming apparatus by the discharge unit 60.

Figure 10I:
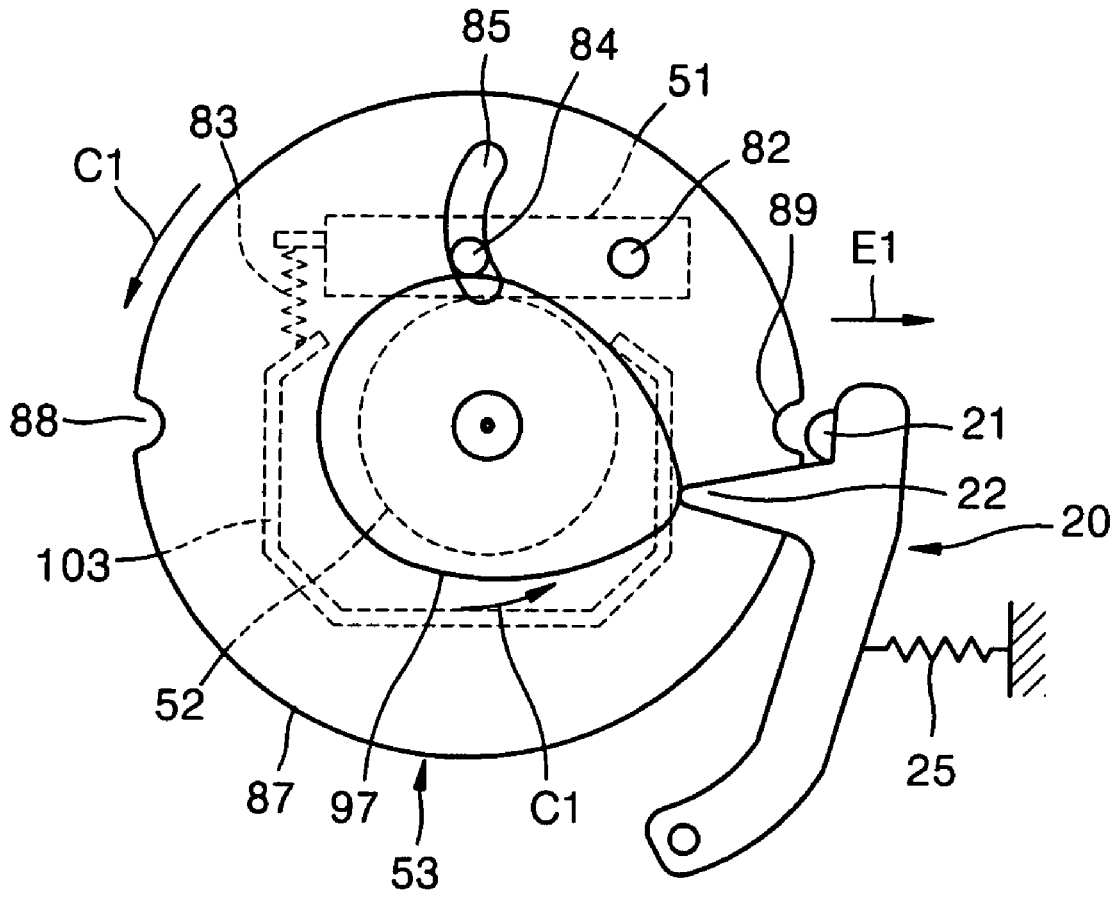

As shown in FIG. 10I, when double-sided image printing is completed, the rotating cam 95 is rotated in direction C1. The cam portion 97 pushes the interfering portion 22 to rotate the locking member 20 in direction E1. Then, the protrusion 21 is disengaged from the second engagement groove 89. Thus, each of the support brackets 53 may be freely rotated. When the cam portion 97 pushes the shaft 84 due to continuous rotation of the rotating cam 95 in direction C1, each of the support brackets 53 is continuously rotated in direction C1 until the protrusion 21 is inserted into the first engagement groove 88 by the elastic force of the elastic member 25. Then, the TPH 51 returns back to the first position as shown in FIG. 10A.

Figure 11C:
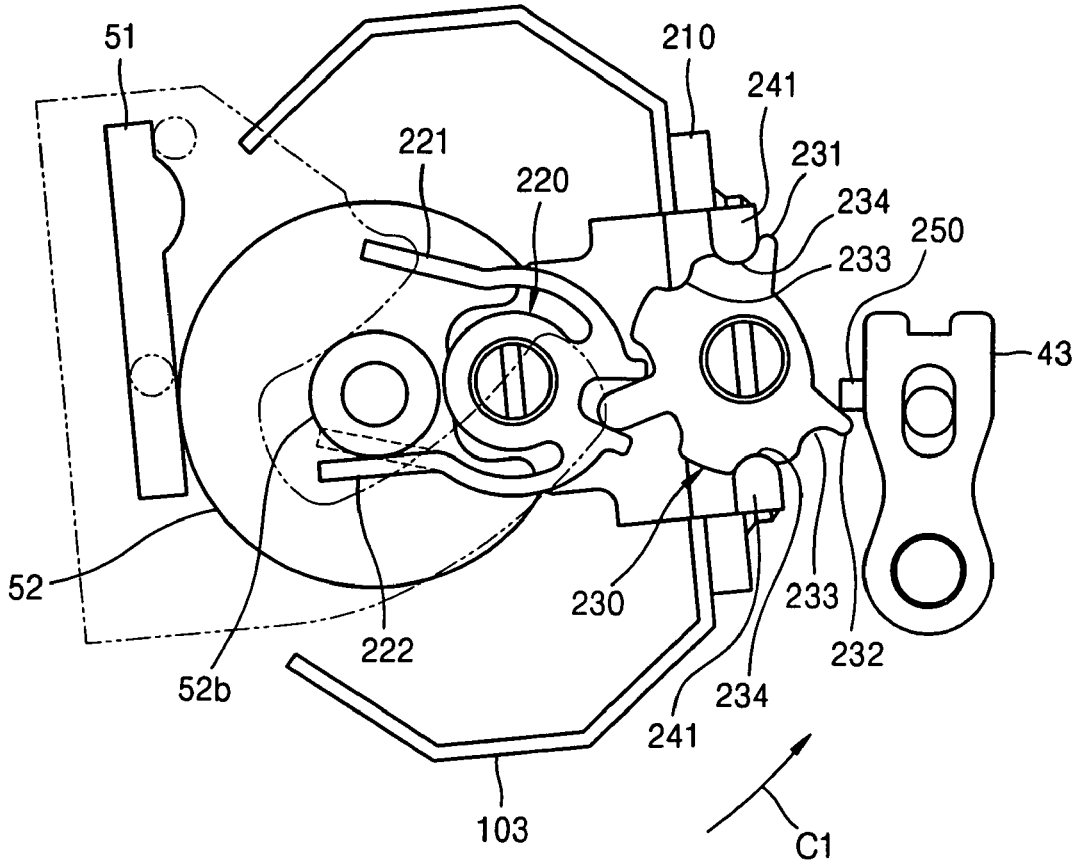
Figure 11D:
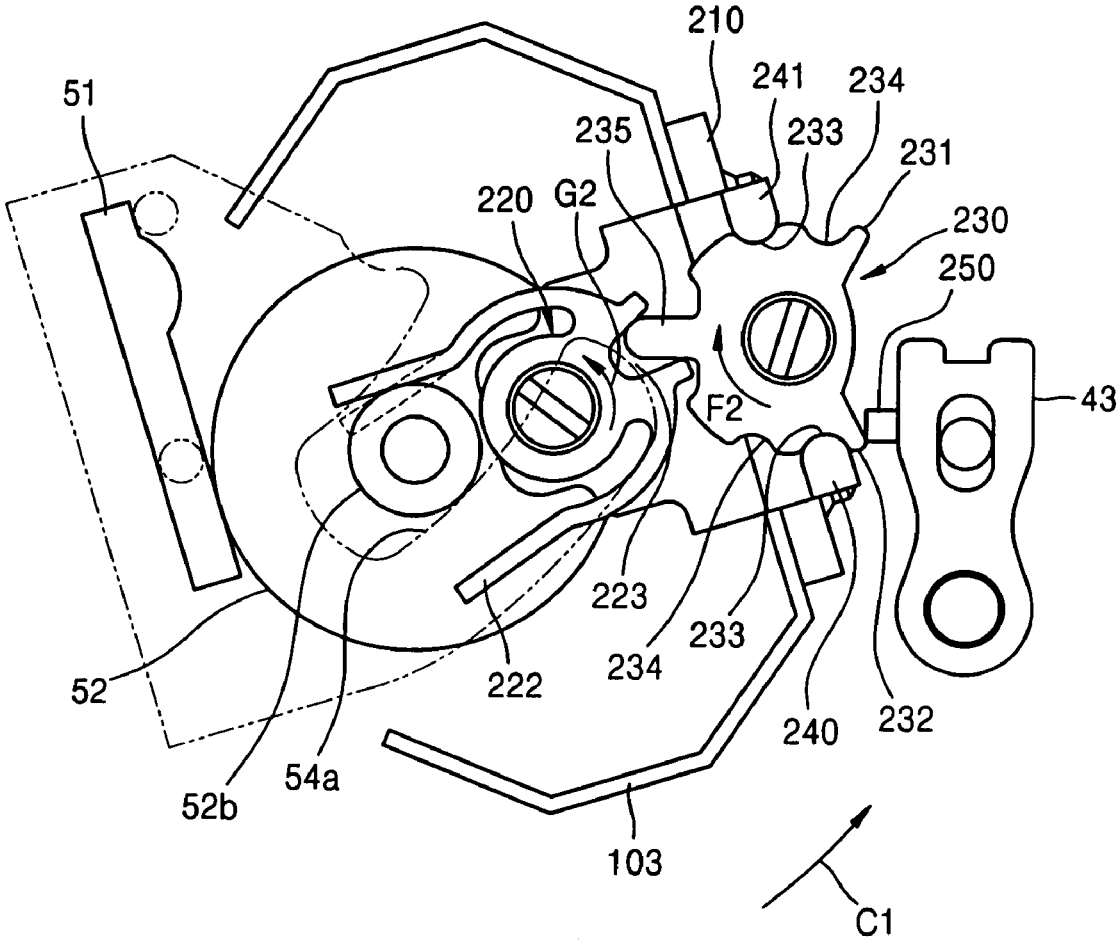

At this time, as shown in FIG. 11C, the second arm 232 of the pivot member 230 interferes with the pivot protrusion 250. As shown in FIG. 11D, the elastic arms 241 are elastically deformed and disengaged from the second projections 234, and the pivot member 230 pivots in direction F2. At this time, the protrusion 235 pushes the concave portion 223, and the bias member 220 pivots in direction G2 to return back to the third position as shown in FIG. 7. The elastic arms 241 are engaged with the first projections 234 to lock the pivot member 230. When the TPH 51 reaches the second position, the first elastic arm 221 of the bias member 220 pushes the platen roller 52 in the second direction A2.

In this state, the TPH 51 may be located in a position away from the platen roller 52 as shown in FIG. 10B. At this position, the TPH 51 may wait for the next printing.

As described above, in the thermal type image forming apparatus in accordance with exemplary embodiments of the present invention, a heating line of a TPH may be aligned with a printing nip when the TPH is located at a first or second position, by applying an elastic force to a platen roller in a transferring direction of a medium to be printed with an image. Therefore, stable printing may be carried out regardless of installing conditions for the image forming apparatus and environments where the image forming apparatus is used.

While the present invention has been particularly shown and described with reference to exemplary embodiments thereof, it will be understood by those of ordinary skill in the art that various changes in form and details may be made therein without departing from the spirit and scope of the exemplary embodiments of the present invention as defined by the appended claims.

What is claimed is:

1. A thermal type image forming apparatus for printing images on both sides of a medium, which are a first surface and a second surface, by rotating a thermal print head (TPH) about a platen roller to a first position facing the first surface of the medium and to a second position facing the second surface of the medium, the thermal type image forming apparatus, comprising:

a transfer unit for transferring the medium in a first direction to supply the medium between the platen roller and the thermal print head and in a second direction substantially opposite to the first direction to perform printing;

a control member for controlling movement of the platen roller in the second direction to align a printing nip formed by the platen roller and the TPH with a heating line of the thermal print head, the control member including a first control portion for controlling movement of the platen roller in the second direction when the thermal print head is located at the first position; and a second control portion for controlling movement of the platen roller in the second direction when the thermal print head is located at the second position; and a bias member elastically biasing the platen roller to contact the control member.

2. The image forming apparatus of claim 1, wherein the bias member includes a first elastic arm and a second elastic arm and moves to the first and second positions together with the thermal print head; and a pivot unit pivots the bias member to a third position and a fourth position such that the first and second elastic arms, respectively, push the platen roller to contact the control member when the thermal print head is located at the first and second positions.

3. The thermal type image forming apparatus of claim 2, wherein the pivot unit includes a pivot protrusion;

a pivot member connected to the bias member to move to the first and second positions together with the thermal print head, and pivoting the bias member to the third and fourth positions while interfering with the pivot protrusion during movement between the first and second positions; and a stopper locking the pivot member when the bias member is located at the third and fourth positions.

4. The thermal type image forming apparatus of claim 3, wherein a pivot member protrusion extends outwardly from the pivot member; and the bias member has a concave portion that receives the pivot member protrusion.

5. The thermal type image forming apparatus of claim 3, wherein the pivot member has first and second recesses; and the stopper has elastic arms elastically engaged with the first and second recesses when the bias member is located at the third and fourth positions, respectively, to lock the pivot member.

6. The thermal type image forming apparatus of claim 3, wherein the stopper is substantially U-shaped.

7. A thermal type image forming apparatus for printing images on both sides of a medium, which are a first surface and a second surface, by rotating a thermal print head (TPH) about a platen roller to a first position facing the first surface of the medium and to a second position facing the second surface of the medium, the thermal type image forming apparatus comprising:

a transfer unit for transferring the medium in a first direction to supply the medium to a space between the platen roller and the thermal print head and in a second direction opposite to the first direction to perform printing; and a control member for rotating together with the thermal print head, the control member including a first control portion controlling a motion of the platen roller in the second direction when the thermal print head is located at the first position and a second control portion controlling a motion of the platen roller in the second direction when the thermal print head is located at the second position;

a holder for moving together with the thermal print head;

a bias member including a first elastic arm and a second elastic arm and pivotally connected to the holder;

a pivot protrusion;

a pivot member connected to the bias member and pivotably connected to the holder, and pivoting the bias member to a third position and a fourth position, where the first and second elastic arms, respectively, can push the platen roller in a direction to contact the control member, while interfering with the pivot protrusion during movement of the thermal print head between the first and second positions; and a stopper locking the pivot member when the bias member is located at the third and fourth positions.

8. The thermal type image forming apparatus of claim 7, wherein the pivot member includes a first arm interfering with the pivot protrusion when the thermal print head moves from the first position to the second position; and a second arm interfering with the pivot protrusion when the thermal print head moves from the second position back to the first position.

9. The thermal type image forming apparatus of claim 8, wherein the pivot member has first and second recesses; and the stopper has elastic arms elastically engaged with the first and second recesses when the bias member is located at the third and fourth positions, respectively, to lock the pivot member.

10. The thermal type image forming apparatus of claim 7, wherein a pivot member protrusion extends outwardly from the pivot member; and the bias member has a concave portion that receives the pivot member protrusion.

11. The thermal type image forming apparatus of claim 7, wherein the stopper is substantially U-shaped.

12. A method of printing on first and second surfaces of a medium with a thermal print head of an image forming apparatus, comprising the steps of printing on the first surface of the medium when the thermal print head is located in a first position;

rotating the thermal print head about a platen roller to a second position;

rotating a control member with the thermal print head, the control member substantially preventing movement of the platen roller in a direction of travel of the medium during printing;

rotating a bias member with the thermal print head;

moving the platen roller to contact the control member with the bias member; and printing on the second surface of the medium when the thermal print head is located in the second position.

13. A method of printing on first and second surfaces of a medium with a thermal print head of an image forming apparatus according to claim 12, further comprising rotating a pivot member connected to the bias member with the thermal print head, the pivot member having first and second elastic arms; and moving the pivot member between third and fourth positions when the thermal print head is rotated between the first and second positions, where the pivot member pushes the bias member to move the platen roller when the pivot member is in the third and fourth positions.

14. A method of printing on first and second surfaces of a medium with a thermal print head of an image forming apparatus according to claim 13, further comprising engaging the first and second elastic arms of the pivot member with a protrusion as the pivot member rotates with the thermal print head between first and second positions to move the pivot member between third and fourth positions.

15. A method of printing on first and second surfaces of a medium with a thermal print head of an image forming apparatus according to claim 14, further comprising engaging first and second elastic arms of the bias member with the platen roller to move the platen roller.

16. A method of printing on first and second surfaces of a medium with a thermal print head of an image forming apparatus according to claim 15, further comprising locking the pivot member in the third and fourth positions with a stopper.

17. A thermal type image forming apparatus for printing images on both sides of a medium, which are a first surface and a second surface, by rotating a thermal print head (TPH) about a platen roller to a first position facing the first surface of the medium and to a second position facing the second surface of the medium, the thermal type image forming apparatus, comprising:

a transfer unit for transferring the medium in a first direction to supply the medium between the platen roller and the thermal print head and in a second direction substantially opposite to the first direction to perform printing;

a control member for controlling movement of the platen roller in the second direction to align a printing nip formed by the platen roller and the TPH with a heating line of the thermal print head;

a bias member elastically biasing the platen roller to contact the control member, the bias member including a first elastic arm and a second elastic arm and moves to the first and second positions together with the thermal print head; and a pivot unit pivoting the bias member to a third position and a fourth position such that the first and second elastic arms, respectively, push the platen roller to contact the control member when the thermal print head is located at the first and second positions.

18. The thermal type image forming apparatus of claim 17, wherein the pivot unit includes a pivot protrusion;

a pivot member connected to the bias member to move to the first and second positions together with the thermal print head, and pivoting the bias member to the third and fourth positions while interfering with the pivot protrusion during movement between the first and second positions; and a stopper locking the pivot member when the bias member is located at the third and fourth positions.

19. The thermal type image forming apparatus of claim 18, wherein the control member includes a first control portion for controlling movement of the platen roller in the second direction when the thermal print head is located at the first position; and a second control portion for controlling movement of the platen roller in the second direction when the thermal print head is located at the second position.

20. The thermal type image forming apparatus of claim 18, wherein a pivot member protrusion extends outwardly from the pivot member; and the bias member has a concave portion that receives the pivot member protrusion.

21. The thermal type image forming apparatus of claim 18, wherein the pivot member has first and second recesses; and the stopper has elastic arms elastically engaged with the first and second recesses when the bias member is located at the third and fourth positions, respectively, to lock the pivot member.

22. The thermal type image forming apparatus of claim 18, wherein the stopper is substantially U-shaped.

* * * * *